US008175491B2

(12) United States Patent
Tomatsu et al.

(10) Patent No.: US 8,175,491 B2
(45) Date of Patent: May 8, 2012

(54) IMAGE FORMING APPARATUS INCLUDING FRAME STRUCTURE FOR SUPPORTING IMAGE FORMING UNIT

(75) Inventors: Yoshiya Tomatsu, Kasugai (JP); Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 188 days.

(21) Appl. No.: 12/503,405

(22) Filed: Jul. 15, 2009

(65) Prior Publication Data

US 2010/0014887 A1 Jan. 21, 2010

(30) Foreign Application Priority Data

Jul. 17, 2008 (JP) ..... 2008-186071
Jul. 17, 2008 (JP) ..... 2008-186072
May 26, 2009 (JP) ..... 2009-126124

(51) Int. Cl.
*G03G 15/00* (2006.01)

(52) U.S. Cl. ..... 399/107

(58) Field of Classification Search ..... 399/107; 347/152, 263
See application file for complete search history.

(56) References Cited

U.S. PATENT DOCUMENTS

| | | | |
|---|---|---|---|
| 2007/0147885 | A1 | 6/2007 | Okabe et al. |
| 2007/0160382 | A1 | 7/2007 | Tomatsu |
| 2008/0002341 | A1 | 1/2008 | Tomatsu |
| 2009/0202271 | A1 | 8/2009 | Okabe et al. |
| 2010/0260518 | A1 | 10/2010 | Okabe et al. |

FOREIGN PATENT DOCUMENTS

| | | | |
|---|---|---|---|
| EP | 1804133 | A2 | 7/2007 |
| JP | 2000-330351 | | 11/2000 |
| JP | 2001-166550 | | 6/2001 |
| JP | 2001-166550 | A | 6/2001 |
| JP | 2003-307894 | | 10/2003 |
| JP | 2004-170644 | A | 6/2004 |
| JP | 2005043540 | A * | 2/2005 |
| JP | 2006-243749 | | 9/2006 |
| JP | 2007-148142 | | 6/2007 |
| JP | 2007-148142 | A | 6/2007 |
| JP | 2007-178657 | A | 7/2007 |
| JP | 2008-009262 | | 1/2008 |

OTHER PUBLICATIONS

JP Office Action dtd Jul. 20, 2010, JP Appln. 2009-126124, partial English translation.
Extended EP Search Report mailed Jan. 14, 2011, EP Appln. 09165685.0.

* cited by examiner

*Primary Examiner* — David Porta
*Assistant Examiner* — Milton Gonzalez
(74) *Attorney, Agent, or Firm* — Banner & Witcoff, Ltd.

(57) ABSTRACT

An image forming apparatus includes: upper frames opposed to each other across an image forming unit; a scanner supporting member that couples the upper frames and supports the scanner unit; and a frame coupling member that couples the upper frames on an opposite side of the scanner supporting member across the photoconductor unit; lower frames, each of which has an upper surface including a plurality of lower supporting portions each contacting a lower end of a respective one of the upper frames, and a lower surface including a bottom supported portion opposed to a placing surface. A stiffness of each of the upper frames in a substantially planar direction along the vertical direction is greater than a stiffness of each of the lower frames along the vertical direction between the lower supporting portions and the bottom supported portion.

35 Claims, 11 Drawing Sheets

A
255R
215R
210R
242
267
211
215R
255R
265R
244
250R
264
268
266
252
F
E
241
272
243
270
271
215R
255R
A
211
210L
265L
261
250L
262
273
213
214
263
256
230
220
212
500
200
UP
DOWN
RIGHT
FRONT
REAR
LEFT

UP
DOWN
RIGHT
FRONT
REAR
LEFT
200
210L
210R
211
212
215L
215R
217
218
220
230
241
242
243
244
250L
250R
252
253
255R
256
257
258
261
262
263
268
270
271
272
273
C

IMAGE FORMING APPARATUS INCLUDING FRAME STRUCTURE FOR SUPPORTING IMAGE FORMING UNIT

CROSS-REFERENCE TO RELATED APPLICATIONS

This application claims priority from Japanese Patent Application No. 2008-186071 filed on Jul. 17, 2008, Japanese Patent Application No. 2008-186072 filed on Jul. 17, 2008, and Japanese Patent Application No. 2009-126124 filed on May 26, 2009, the entire contents of which are incorporated herein by reference.

TECHNICAL FIELD

The present invention relates to an image forming apparatus including an image forming unit configured to form an image on a recording medium, and more particularly to a frame structure that supports such an image forming unit.

BACKGROUND

In an image forming apparatus, an image forming unit including a photoconductor and a scanner unit is supported by sidewalls disposed on either side thereof. For example, a related-art image forming apparatus has a structure in which a sheet-metal frame and a resin frame which are overlapped in their thickness direction (in the right-left direction) to form a sidewall, the sheet-metal frame supports a photoconductor and a scanner unit to determine the relative position therebetween, and the resin frame supports a belt for conveying a recording medium, a fixing unit for fixing a toner image on the recording medium, and a discharge unit for discharging the recording medium. That is, since it is difficult to form supporting portions for supporting a number of modules in the sheet-metal frame through sheet metal processing, the sheet-metal frame supports only modules that require positional accuracy, while the resin frame supports the other modules.

In the structure described above, the resin frame defines the entire height of the sidewall, and the sheet-metal frame is disposed only in the upper part of the sidewall. The upper ends of a pair of upper frames are coupled via a scanner supporting plate, the intermediate parts of a pair of resin frames extending below the sheet-metal frame are coupled via a base plate, and the lower ends of the frames are coupled via a bottom plate.

SUMMARY

In the structure described above, the pair of sheet-metal frames is coupled only via the upper ends thereof. Therefore, if a distortion of the resin frames such as deflection and/or torsion on the resin frames is caused due to a placement of the image forming apparatus on an uneven placing surface, a strong force applied to the upper surface of the apparatus, or an upward impact applied to the apparatus when dropped a little, a relative position between the pair of sheet-metal frames is affected and consequently the relative position between the photoconductor and the scanner unit is changed, which makes it impossible to form images accurately on recording medium such as paper.

An object of the present invention is to provide an image forming apparatus including a pair of upper frames supporting an image forming unit and a pair of lower frames supporting the upper frames capable of reducing the distortions such as deflection and/or torsion on the upper frames to thereby form an image on a recording medium accurately.

According to an aspect of the invention, there is provided an image forming apparatus comprising: an image forming unit comprising a photoconductor unit and a scanner unit configured to scan and expose the photoconductor unit, the image forming unit being configured to form an image on a recording medium conveyed with respect to the photoconductor unit; a frame body that surrounds the photoconductor unit, the frame body comprising: a pair of upper frames extending substantially in parallel with each other in a vertical direction and an anteroposterior direction perpendicular to the vertical direction so as to be opposed to each other across the image forming unit, the upper frames comprising a positioning portion configured to position the photoconductor unit; a scanner supporting member that couples the upper frames in a bridging manner and supports the scanner unit; and a frame coupling member that couples the upper frames in a bridging manner on an opposite side of the scanner supporting member across the photoconductor unit, a pair of lower frames provided below the upper frames and extending substantially in parallel with the upper frames in the anteroposterior direction, each of the lower frames having an upper surface and a lower surface opposite the upper surface, the upper surface comprising a plurality of lower supporting portions each contacting a lower end of a respective one of the upper frames so as to support the respective one of upper frames thereon, and the lower surface comprising a bottom supported portion opposed to a placing surface for supporting the image forming apparatus; and wherein the plurality of lower supporting portions of each of the lower frames comprise a pair of outermost lower supporting portions in the anteroposterior direction, wherein a stiffness of each of the upper frames in a substantially planar direction along the vertical direction is greater than a stiffness of each of the lower frames along the vertical direction between the lower supporting portions and the bottom supported portion.

According to another aspect of the invention, there is provided an image forming apparatus configured to form an image on a recording medium conveyed with respect to an image forming unit, said apparatus comprising: a pair of upper frames extending substantially in parallel with each other in a vertical direction and an anteroposterior direction perpendicular to the vertical direction so as to support the image forming unit; a pair lower frames provided below the upper frames and extending substantially in parallel with the upper frames in the anteroposterior direction, each of the lower frames having an upper surface and a lower surface opposite the upper surface, the upper surface comprising a plurality of lower supporting portions each contacting a lower end of a respective one of the upper frames so as to support the respective one of the upper frames thereon, and the lower surface comprising a bottom supported portion opposed to a placing surface for supporting the image forming apparatus; and a coupling member that couples the upper frames in a bridging manner, wherein a stiffness of each of the upper frames in a substantially planar direction along the vertical direction is greater than a stiffness of each of the lower frames along the vertical direction between the lower supporting portion and the bottom supported portion, wherein the plurality of lower supporting portions of each of the lower frames comprise a pair of outermost lower supporting portions in the anteroposterior direction, wherein a center of gravity of a unit comprising the image forming unit, the upper frames, the coupling member, and a driving unit configured to drive the image forming unit is located closer to one of the upper frames than an intermediate position between the upper frames, and the center of gravity of the unit being also located inside an outline defined by connecting the outermost lower supporting portions of the lower frames in plan view, and wherein an anteroposterior distance between the outermost lower supporting portion of the one of the lower frames is greater an anteroposterior distance between the outermost lower supporting portion of the other of the lower frames.

BRIEF DESCRIPTION OF DRAWINGS

FIG. 4A is an upper right rear perspective view showing the structure of the main body frame and FIG. 4B is an enlarged view of the section B;

FIGS. 11A and 11B show an exemplary modification, in which FIG. 11A is a partial side view of each lower frame and FIG. 11B is a partial perspective view of the lower frame when viewed from below.

DESCRIPTION (Overall Configuration of Laser Printer)

Figure 1:
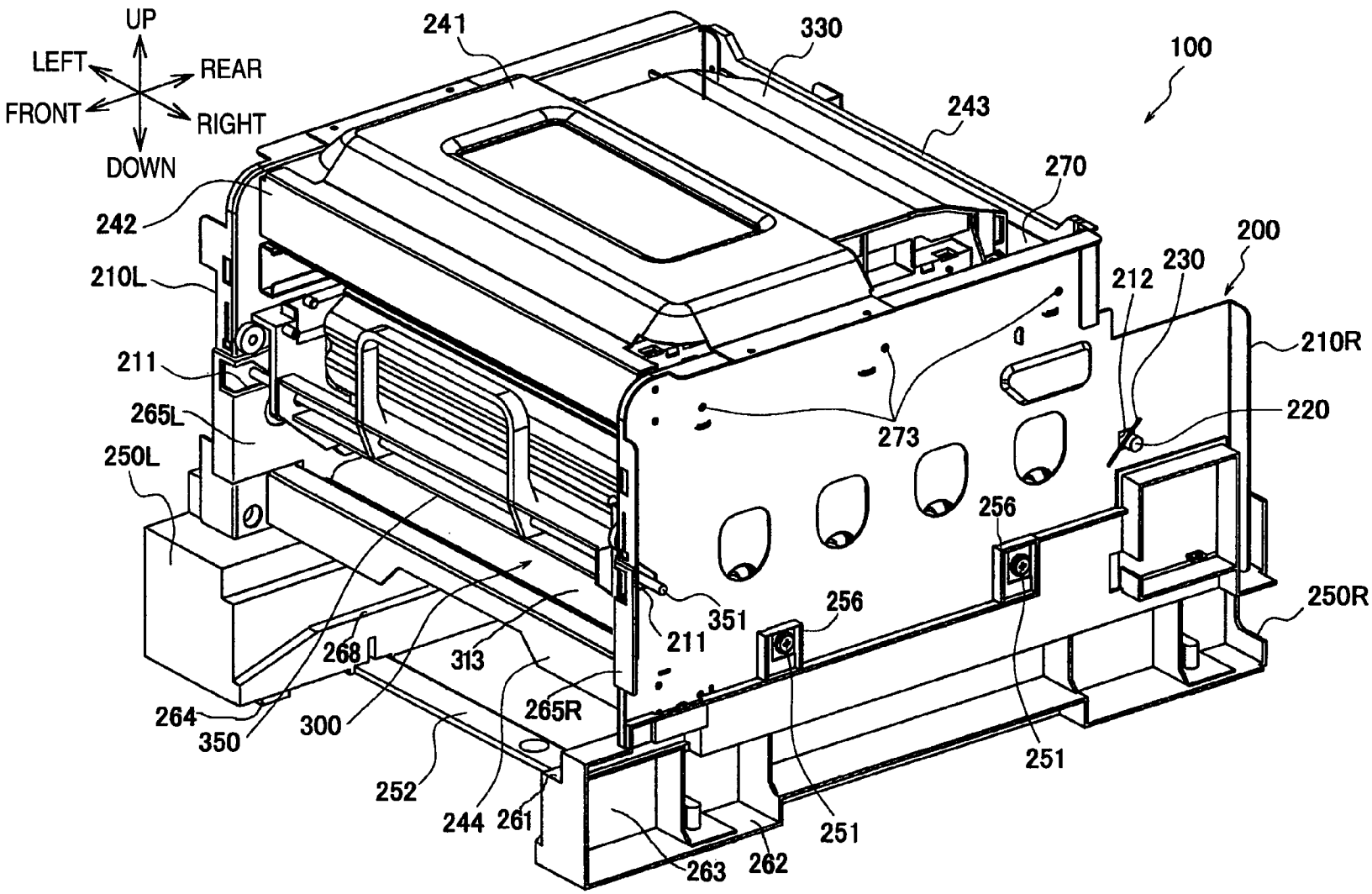
FIG. 1 is a perspective view showing a laser printer according to an exemplary embodiment of the present invention.

Exemplary embodiments of the present invention will be described hereinafter. In the exemplary embodiments, a laser printer 100 is illustrated as an example. FIG. 1 is a perspective view showing an internal structure of the laser printer 100. It is noted that the left side in FIG. 1 corresponds to a front side in the following description. The laser printer 100 includes a substantially box-shaped main body frame 200 an image forming unit 300 supported in the main body frame 200. It is noted that the outer surface of the main body frame 200 is covered with a resin exterior cover (not shown).

(Image Forming Unit)

Figure 2:
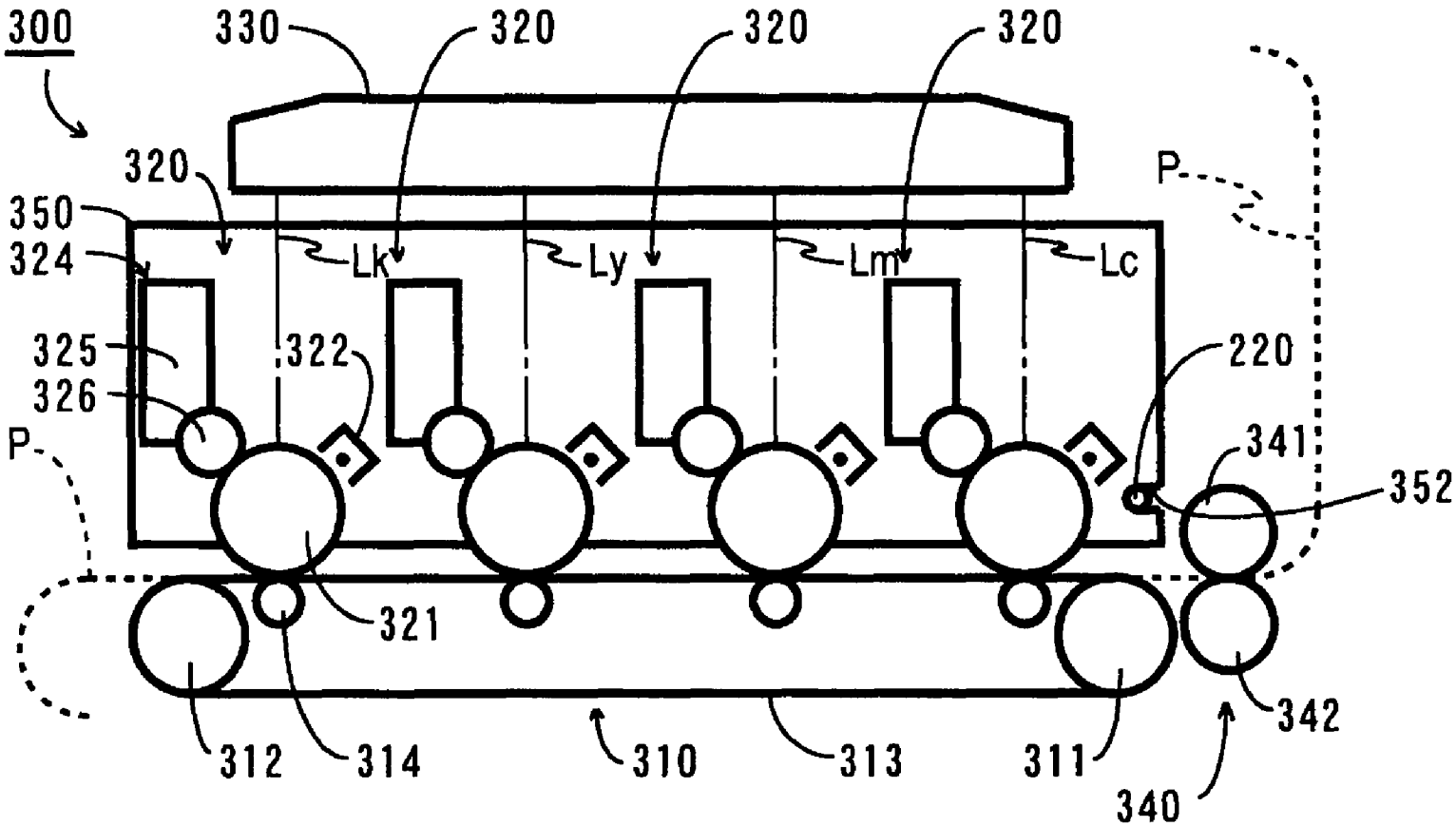
FIG. 2 is a cross-sectional view schematically showing the structure of an image forming unit in the laser printer.

FIG. 2 is a cross-sectional view schematically showing the image forming unit 300. The image forming unit 300 includes: a plurality of image forming units 320 corresponding to respective colors, for example, of black (K), yellow (Y), magenta (M) and cyan (C); a scanner unit 330; and a belt unit 310. The plurality of image forming units 320 are arranged in a front and rear direction in the order of black, yellow, magenta, and cyan from the front side of the laser printer 100 so as to form a tandem-type color image forming unit. The plurality of image forming units 320 are also held individually and detachably in respective housing members (not shown) provided in a drawer unit 350 that is mounted to be capable of being drawn from the main body frame 200.

Each of the image forming units 320 each includes: a cylindrical drum-shaped photoconductor unit 321; a scorotron charger 322; and a developing cartridge 324. The photoconductor unit 321 includes a metallic drum main body connected to a ground, the surface of which is covered with a positively chargeable photoconductive layer made, for example, of polycarbonate. It is noted that the photoconductor unit 321 may be of an endless belt type.

The scorotron charger 322 is disposed obliquely rearward and upward from the photoconductor unit 321 to be opposed to the photoconductor unit 321 with a given distance so as not to contact the photoconductor unit 321. The scorotron charger 322 is configured to uniformly and positively charge the surface of the photoconductor unit 321 by generating a corona discharge from charging wires made, for example, of tungsten. The developing cartridge 324 may be a well-known one. For example, the developing cartridge 324 includes a toner accommodation chamber 325 and configured to frictionally and positively charge respective one of black, cyan, magenta, and yellow positively chargeable nonmagnetic one-component toner accommodated in the chamber and then supply the toner to the photoconductor unit 321 via a developing roller 326.

The belt unit 310 includes a driving roller 311, a driven roller 312, and a conveying belt 313 provided in a suspended manner between the driving roller 311 and the driven roller 312. The conveying belt 313 extends along an arranging direction of the photoconductor units 321 in the plurality of image forming units 320 and is configured to be rotatably driven in this direction with the rotation of the driving roller 311. The belt unit 310 further includes a plurality of transferring rollers 314 arranged at opposed positions of the respective photoconductor units 321 across the conveying belt 313. A recording medium such as a sheet P is fed by various rollers (not shown) including a sheet feed roller from a sheet feed tray 269 onto the conveying belt 313, and the sheet P is conveyed to the rear of the laser printer 100 via portions opposed to the photoconductor units 321. The sheet P may be paper, for example.

The scanner unit 330 is disposed above the plurality of image forming units 320. The scanner unit 330 is configured to scan and expose the photoconductor units 321 and may be well-known. In this exemplary embodiment, the scanner unit 330 includes: semiconductor lasers configured to generate laser beams Lk, Ly, Lm, and Lc for the corresponding color image data; and a polygon mirror for deflecting the laser beams L (not shown). When the photoconductor units 321 rotate, the surface of the photoconductor units 321 are first charged uniquely and positively by the respective scorotron chargers 322. Then, the photoconductor units 321 are exposed to rapid scanning laser beams L from the scanner unit 330, and thus electrostatic latent images corresponding to an image to be formed on the sheet P are formed on the photoconductor units 321. Next, with the rotation of the developing rollers 326, positively charged toners supported on the developing rollers 326 are brought into contact with the respective photoconductor units 321 and supplied to the electrostatic latent images formed on the surfaces of the respective photoconductor units 321. Accordingly, the electrostatic latent images on the photoconductor units 321 are visualized, and the surfaces of the photoconductor units 321 carry toner images formed of toner particles attached to the exposed portions.

Thereafter, when the sheet P is conveyed by the conveying belt 313 to pass between the photoconductor units 321 and the transferring rollers 314, the toner images supported on the surfaces of the photoconductor units 321 are transferred sequentially to the sheet P by a negative transferring bias applied to the transferring rollers 314 via constant current control. It is noted that the toner images may be transferred to the belt 313 and then transferred from the belt 313 to the sheet P.

The sheet P with the toner images thus being transferred thereon is conveyed to a fixing unit 340 disposed at the rear of the belt unit 310.

The fixing unit 340 includes: a heating roller 341 including a heat source such as a halogen lamp and configured to be rotatably driven; and a pressure roller 342 disposed below and opposed to the heating roller 341 so as to press the heating roller 341 and configured to be rotatably driven. In the fixing unit 340, the sheet P with four colors of toner images supported thereon is conveyed and heated between the heating roller 341 and the pressure roller 342 so as to thermally fix the toner images onto the sheet P. Then, the sheet P with the toner images thermally fixed thereon is discharged to a sheet discharge tray (not shown) provided on an upper surface of the laser printer 100 via various rollers (not shown).

(Main Body Frame)

The main body frame 200 is formed in a substantially box shape and includes upper frames 210L and 210R and lower frames 250L and 250R that form a lateral (right and left direction) pair of sidewalls and coupling members 241, 242, 243, 244, 252, 253, and 270 for coupling and fixing the pair of sidewalls.

The upper frames 210L and 210R are made of sheet metal such as sheet steel, which rises in a vertical direction (up and down direction) on either side of the image forming unit 320 substantially in parallel with each other and is formed in a flat plate extending in an anteroposterior direction (front and rear direction) perpendicular to the vertical direction (in parallel with the direction in which the sheet P is conveyed on the belt 313). The outer circumference of each frame has a folded edge folded in a direction perpendicular to the flat plate to increase the stiffness of each frame.

The lower frames 250L and 250R are made of resin, which extends in the anteroposterior direction below and in parallel with the upper frames 210L and 210R and has an anteroposterior length substantially the same or a little longer than the upper frames. Further, each of the lower frames 250L and 250R includes as an integrally molded form: an upper wall 261 extending substantially in a horizontal direction; a lower wall 262 spaced downward from the upper wall 261 and extending substantially in the horizontal direction; and a sidewall 263 coupling the upper and lower walls 261, 262 and extending substantially in the vertical direction, in which a laterally opened internal space surrounded by the upper, lower, and sidewalls 261, 262, 263 is provided. This shape has a large modulus of section to support the weights of the upper frames 210L and 210R and the image forming unit 320 stably in an ordinary state, and can be strengthened, as appropriate, by coupling the upper and lower walls 261, 262 via a plurality of ribs.

The lower frames 250L and 250R support the respective upper frames 210L and 210R on the upper surface of the upper wall 261 (specifically, pedestal portions 255L and 255R), as will be described hereinafter, and the lower surface of the lower wall 262 faces a placing surface 260 (see FIG. 7) for supporting the image forming apparatus. In the vicinity of the longitudinal ends of the lower wall 262, the lower surface has legs 264 (see FIG. 7) protruding downward to be in contact with the placing surface 260. Since the upper frames 210L, 210R are made of metal and the lower frames 250L, 250R are made of resin, a stiffness of each of the upper frames 210L, 210R in a substantially planar direction along the vertical direction is greater than a stiffness of each of the lower frames 250L, 250R along the vertical direction between the pedestal portions 255L, 255R and the legs 264. However, the material contained in the upper frames 210L, 210R and the material contained in the lower frames 250L, 250R are not limited thereto, and may be any material as long as the stiffness of the upper frames 210L, 210R is greater than the stiffness of the lower frames 250L, 250R.

Figures 3A, 3B:
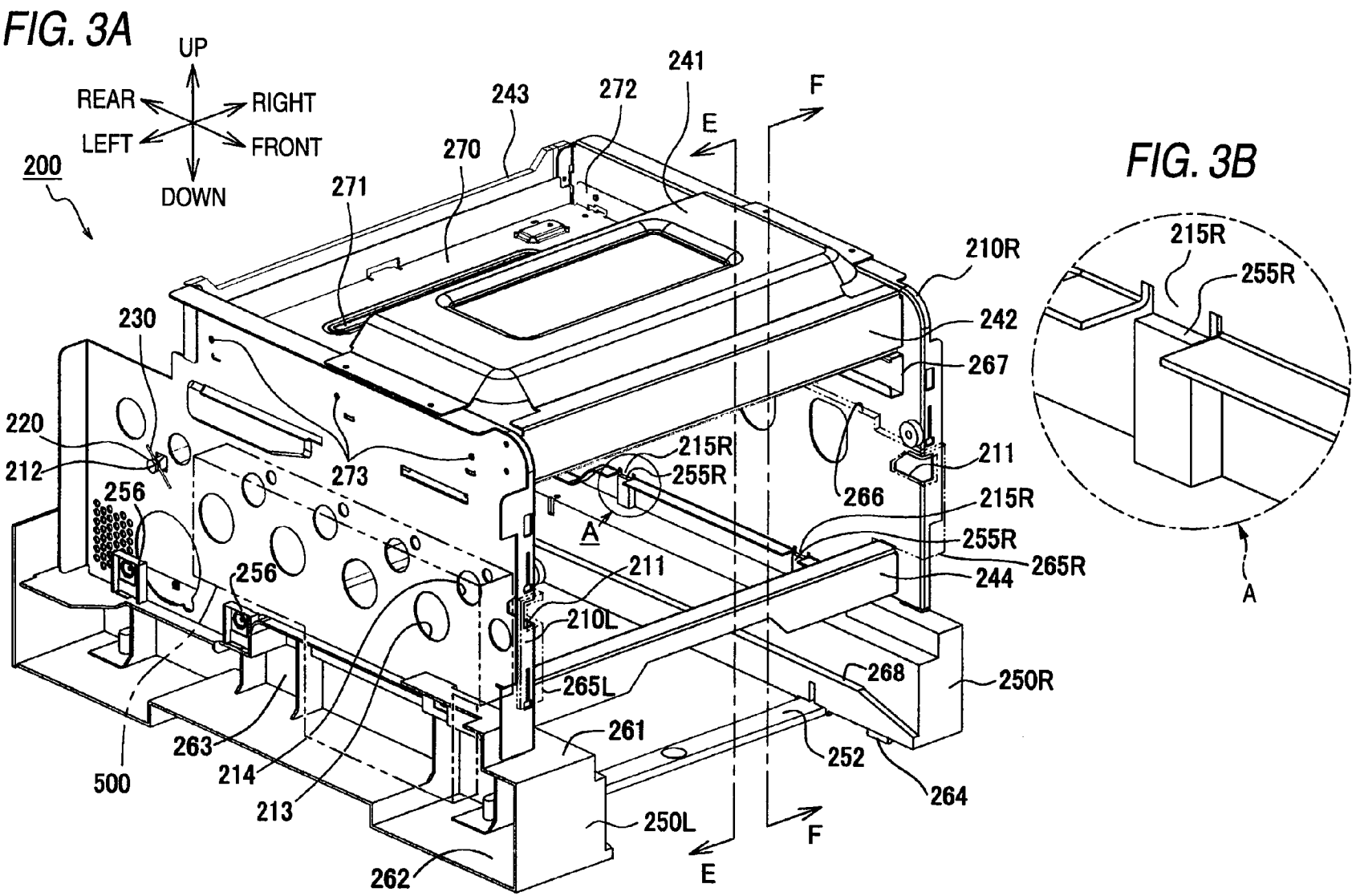
FIG. 3A is an upper left front perspective view showing the structure of a main body frame in the laser printer excluding a drawer unit and a scanner unit and FIG. 3B is an enlarged view of the section A.
Figure 4A:
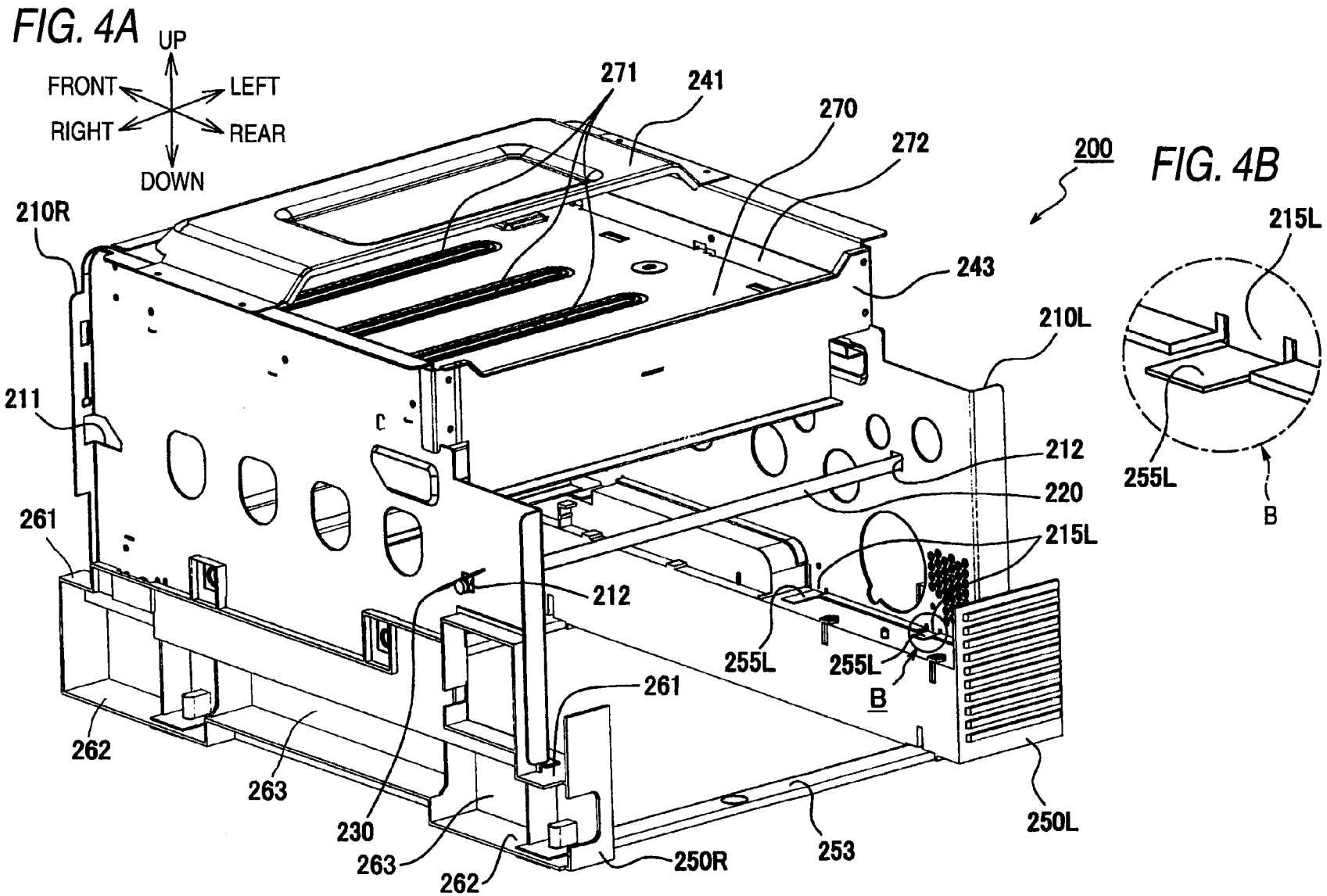
Figures 5A, 5B:
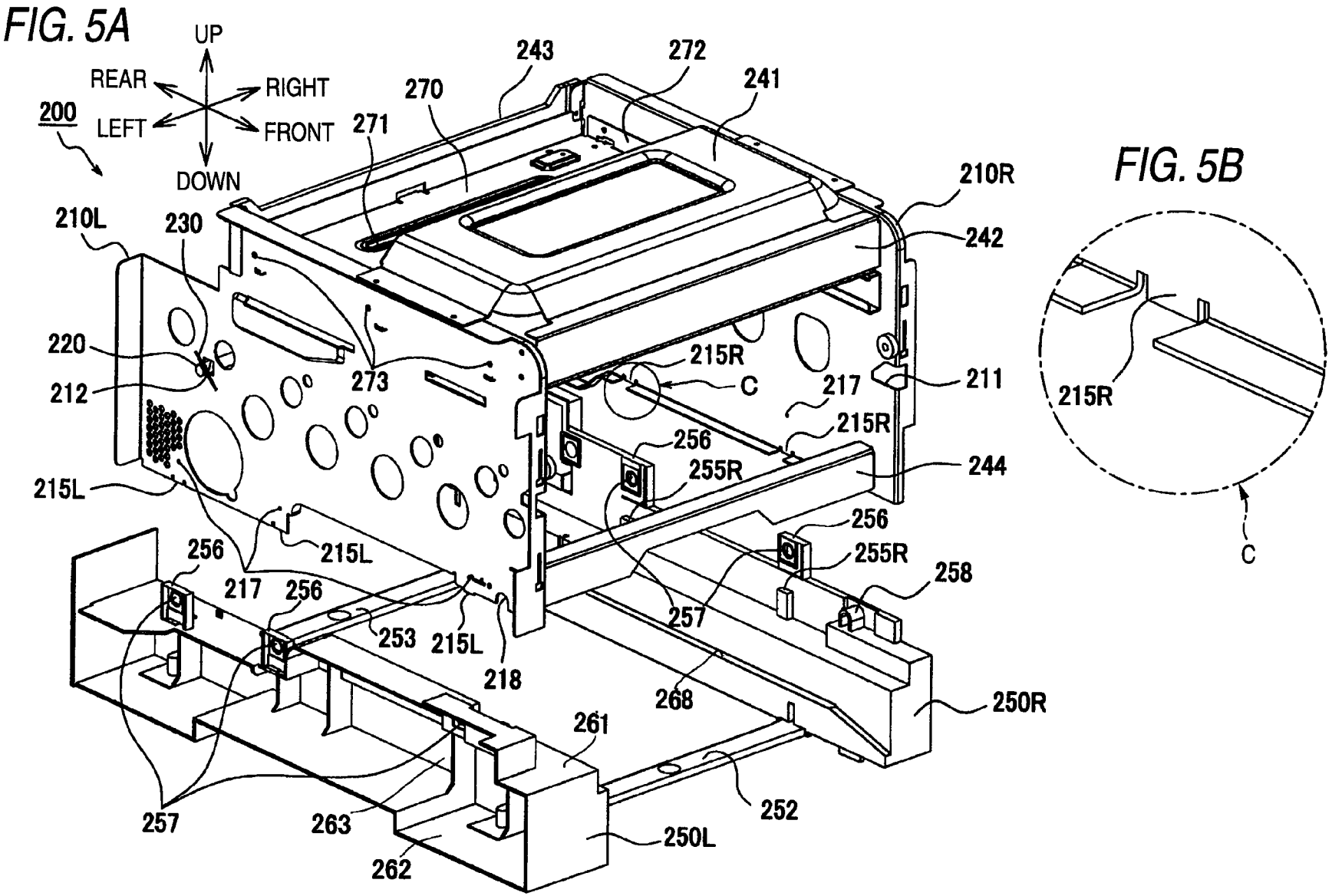
FIG. 5A is an exploded perspective view when the upper frames and the lower frames are separated in FIG. 3
FIG. 5B is an enlarged view of the section C.
Figures 6A, 6B:
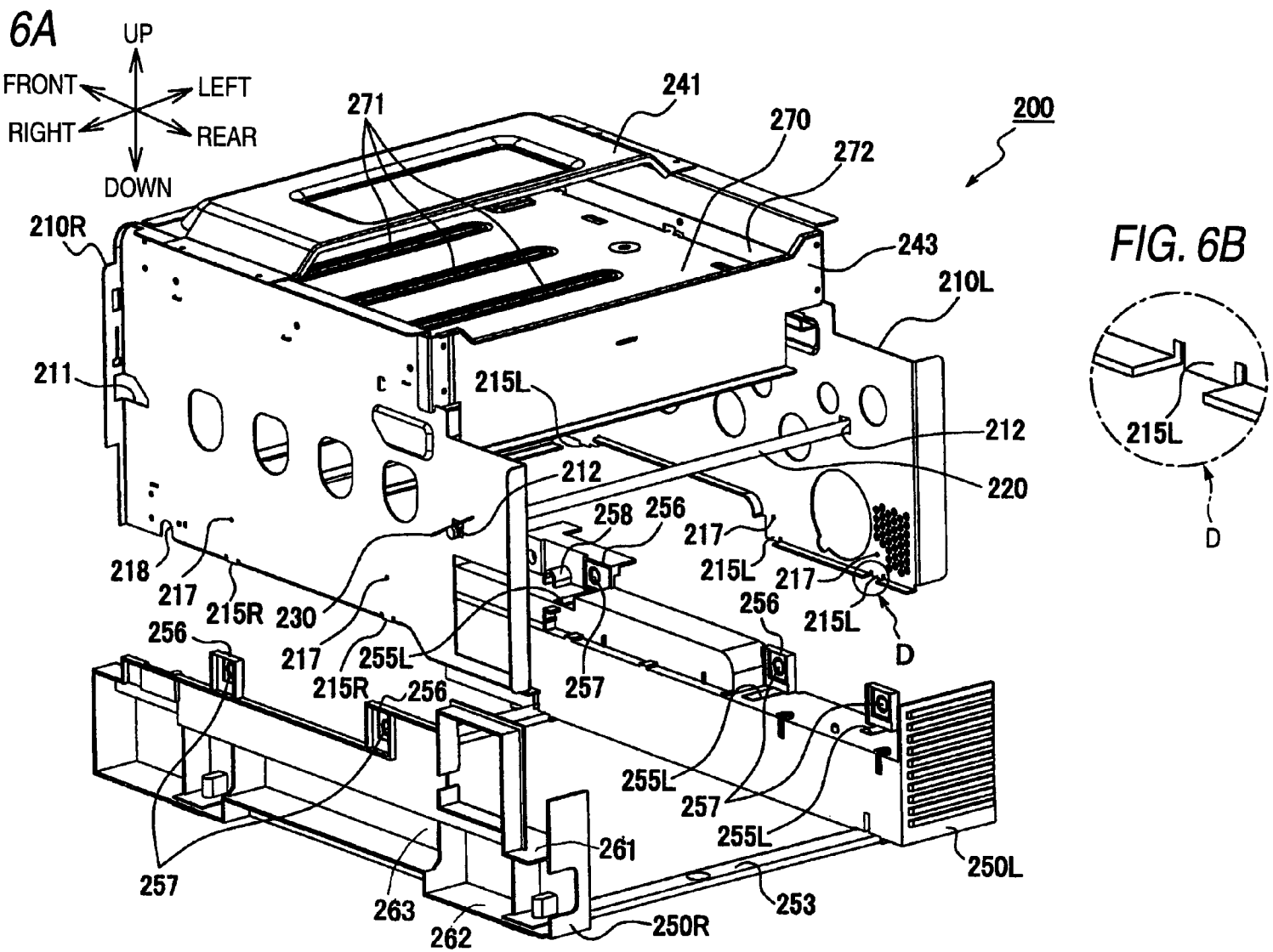
FIG. 6A is an exploded perspective view when the upper frames and the lower frames are separated in FIG. 4
FIG. 6B is an enlarged view of the section D.

One of the coupling members coupling the upper frames 210L and 210R is a sheet-metal scanner plate 270 for supporting the scanner unit 330. The left and right end edges 272 of the scanner plate 270 are bent upward at a right angle and fixed to the upper end parts on the inner surfaces of the lateral pair of upper frames 210L and 210R using screws 273 at a plurality of anteroposterior portions. This causes the scanner plate 270 to be supported horizontally between the pair of upper frames 210L and 210R. The scanner plate 270 supports the scanner unit 330 on the upper surface thereof and has a plurality of slits 271 (see FIGS. 3A and 4A) for passage of laser beams L at positions corresponding to the respective photoconductor units 321.

A sheet-metal scanner cover 241 for covering the front half of the scanner unit 330 from above is fixed using screws to folded edges folded outward from the upper ends of the pair of upper frames 210L and 210R. The scanner cover 241 serves also as one of the coupling members coupling the upper frames 210L and 210R.

Some of the other coupling members are a front beam 242, a rear beam 243, and a frame coupling member 244, respectively, coupling and fixing upper front corners, upper rear corners, and lower front portions of the inner surfaces of the lateral pair of upper frames 210L and 210R. Yet other remaining coupling members are a front beam 252 and a rear beam 253 coupling and fixing the lower walls 262 of the lateral pair of lower frames 250L and 250R. These coupling members 242, 243, 244, 252, and 253 are made of bent sheet metal or reinforced resin, and the left and right ends thereof are fixed using screws to the inner surfaces of the upper frames 210L and 210R or the lower walls 261 of the lower frames 250L and 250R. It is noted that the reinforced resin may be, for example, glass, filler, or resin reinforced by other additives.

The frame coupling member 244 is located below the drawer unit 350. It is noted that the frame coupling member 244 may serve also as a unit chassis including rollers for feeding recording media from the sheet feed tray 269 to the conveying belt 313.

In addition, the front beam 242 at the upper front corner may be formed integrally on the front end of the scanner cover 241 or the scanner plate 270.

The pair of upper frames 210L and 210R and the coupling members 241, 242, 243, 244, and 270 coupling the frames form a frame body that surrounds the drawer unit 350 on a plane perpendicular to the anteroposterior direction (i.e. in anteroposterior view). The pair of lower frames 250L and 250R, which are coupled and fixed to each other via the beams 252 and 253, are connected below the frame body to form another frame body in cooperation with the frame body above. That is, the pair of lower frames 250L and 250R, which are located below the pair of upper frames 210L and 210R formed in a frame body, are further coupled and fixed to each other via the beams 252 and 253 to ensure a predetermined overall strength.

The spaces in the former and latter frame bodies, which are opened in the anteroposterior direction, may be opened only forward so that the drawer unit 350 and the sheet feed tray 269 can be drawn.

Inner support plates 265L and 265R (see FIGS. 3 and 9) are fixed to the pair of upper frames 210L and 210R along the mutually facing inner surfaces thereof. The upper end faces of the inner support plates 265L and 265R are formed as rail members 266 extending substantially linearly in the anteroposterior direction, and above the rail members 266, guide members 267 that form guide spaces in cooperation with the rail members 266 are fixed to the inner surfaces of the upper frames 210L and 210R. The drawer unit 350 is supported back-and-forth slidably on the lateral pair of rail members 266. The image forming units 320 can be attached and detached to/from the drawer unit 350 with the drawer unit 350 being drawn forward from the upper frames 210L and 210R.

The drawer unit 350 has shaft members 351 protruding leftward and rightward in the vicinity of the front end thereof (see FIG. 1) and notched portions 352 opened rearward at the rear end thereof (see FIG. 2). When the drawer unit 350 is in the main body frame 200, the shaft members 351 are engaged with a pair of openings 211 formed at the front end of the pair of upper frames 210L and 210R, while the notched portions 352 are engaged with a shaft member 220 supported between the pair of upper frames 210L and 210R.

The openings 211 at the front end are opened forward and formed by extending their lower walls horizontally. The front end of the drawer unit 350 is positioned in the vertical direction by placing the shaft members 351 on the lower walls of the openings 211. The rear shaft member 220 is inserted and supported into a pair of rectangular holes 212 bored, respectively, in the pair of upper frames 210L and 210R in a mutually opposed manner, and urged by linear springs 230 toward the lower rear corner of the holes 212. The rear end of the drawer unit 350 is positioned in the vertical and anteroposterior directions at the corner of the holes 212 via the notched portions 352 and the shaft member 220.

Thus, when the drawer unit 350 is loaded in the main body frame 200, the plurality of photoconductor units 321 are positioned at a predetermined distance from the scanner unit 330 and at a predetermined position in the anteroposterior direction.

In the left upper frame 210L and the inner support plate 265L, circular holes 213 and 214 are bored into which drive couplings (not shown) for driving the photoconductor units 321 and the developing rollers 326 are inserted. As indicated by imaginary lines in FIG. 3A, a driving unit 500 for motor driving of the drive couplings is fixed on the outside of the left upper frame 210L. It is noted that since the structures of such drive couplings and driving unit 500 is known, detailed descriptions thereof will be omitted.

The side surface of the drawer unit 350 facing the right inner support plate 265R has an electrical contact (not shown) disposed thereon and connected to the image forming units 320, and the right inner support plate 265R also has an electrical contact disposed thereon to be in contact with the electrical contact above. When the electrical contacts are in contact with each other, the components in the image forming units 320 can be supplied with power or grounded.

The openings 211 and the holes 212 are bored, for example, by press working in the upper frames 210L and 210R simultaneously with the circular holes 213 and 214 and screw holes (reference symbols thereof are omitted from the drawings) into which the screws 273 are inserted. In addition, a portion of each of the upper frames 210L and 210R, which is surrounded by the screw holes, the openings 211 and the holes 212, is formed to have a flat shape with no folded portions. This allows a good positional accuracy between the scanner unit 330 and the drawer unit 350 to be ensured in the laser printer 100 and therefore a good positional accuracy between the scanner unit 330 and each photoconductor unit 321 to be ensured to form accurate images.

The belt unit 310 is detachably mounted in a bridging manner between portions below the pair of inner support plates 265L and 265R and is opposed to photoconductor units 321 at the mount position. The fixing unit 340 is mounted in a bridging manner between portions at the rear of the pair of upper frames 210L and 210R. It is noted that the belt unit 310 and the fixing unit 340 may be mounted between the pair of lower frames 250L and 250R.

Figure 10:
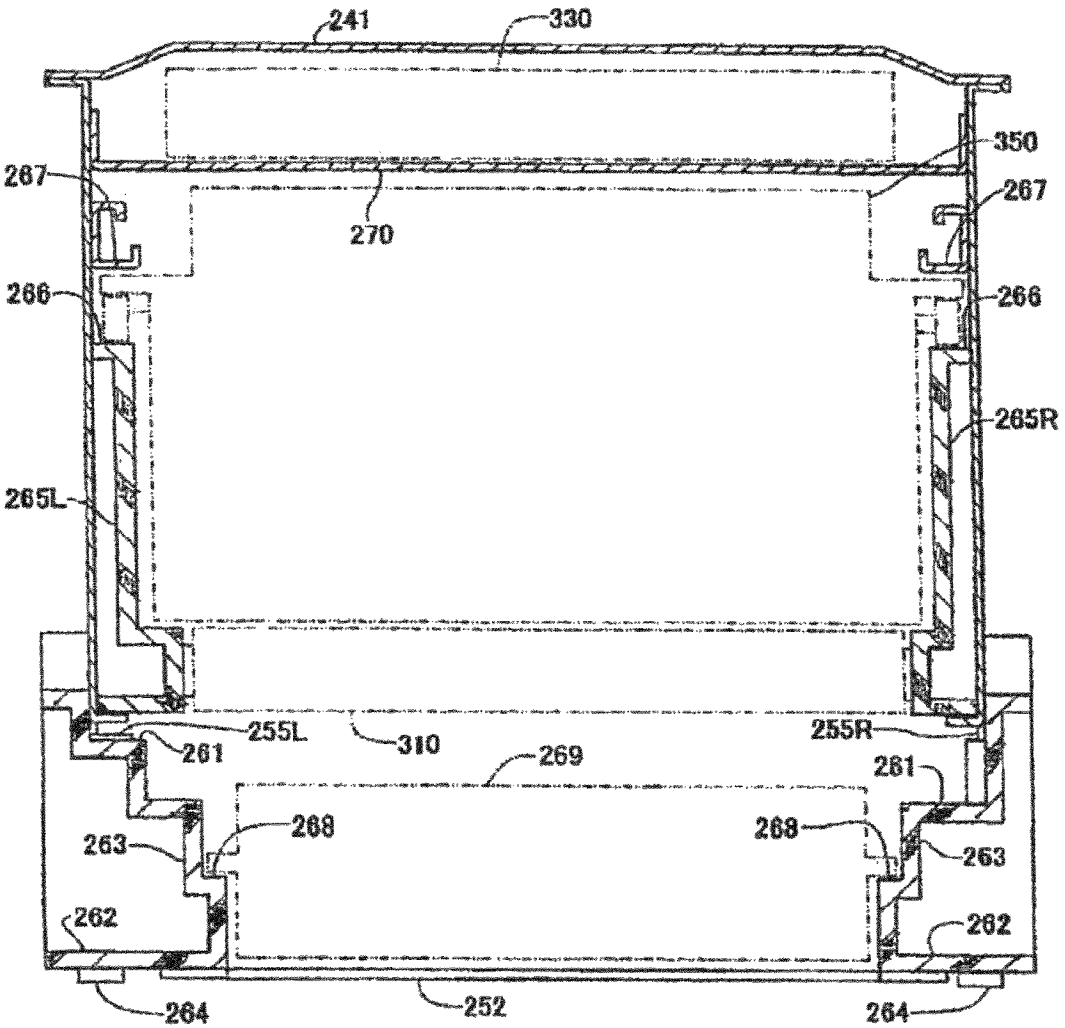
FIG. 10 is a cross-sectional view showing the structure of the main body frame cut along a plane extending in a right and left direction.

The sheet feed tray 269 (see FIG. 10) with sheets P accommodated therein is arranged between the pair of lower frames 250L and 250R and on or above the front beam 252 and the rear beam 253. The sheet feed tray 269 is supported back-and-forth slidably on the rail members 268 that are provided on the mutually facing side surfaces of the pair of lower frames 250L and 250R. When the sheet feed tray 269 is drawn forward from between the pair of lower frames 250L and 250R, the sheet feed tray 269 can be replenished with the sheet P, while when the sheet feed tray 269 is loaded to the predetermined position below the belt unit 310, a roller can be brought into contact with the sheet P in the sheet feed tray 269 to feed the sheet P toward the belt unit 310.

(Support Structure of Upper Frames on Lower Frames)

The lower end edges of the pair of upper frames 210L and 210R are partially formed as rectangular protruding pieces 215L and 215R protruding downward without being folded inward. The lower frames 250L and 250R include the pedestal portions 255L and 255R protruding toward an inner side in the right and left direction and having flat upper surfaces at positions corresponding to the protruding pieces 215L and 215R. The pair of upper frames 210L and 210R is placed such that the low ends of the protruding pieces 215L and 215R contact the upper surfaces of the pedestal portions 255L and 255R, respectively.

Figure 7:
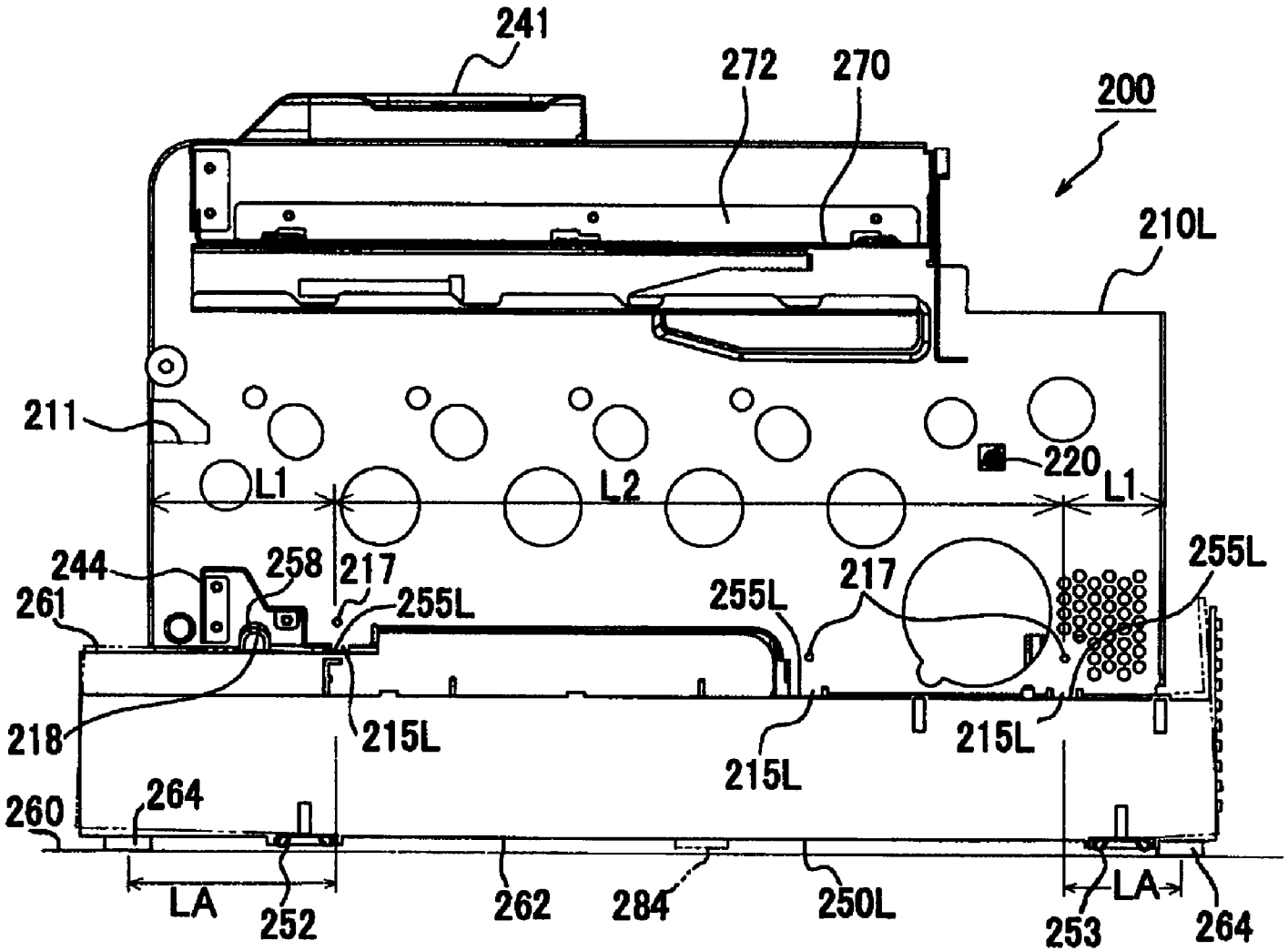
FIG. 7 is a cross-sectional view along the line E-E in FIG. 3.
Figure 8:
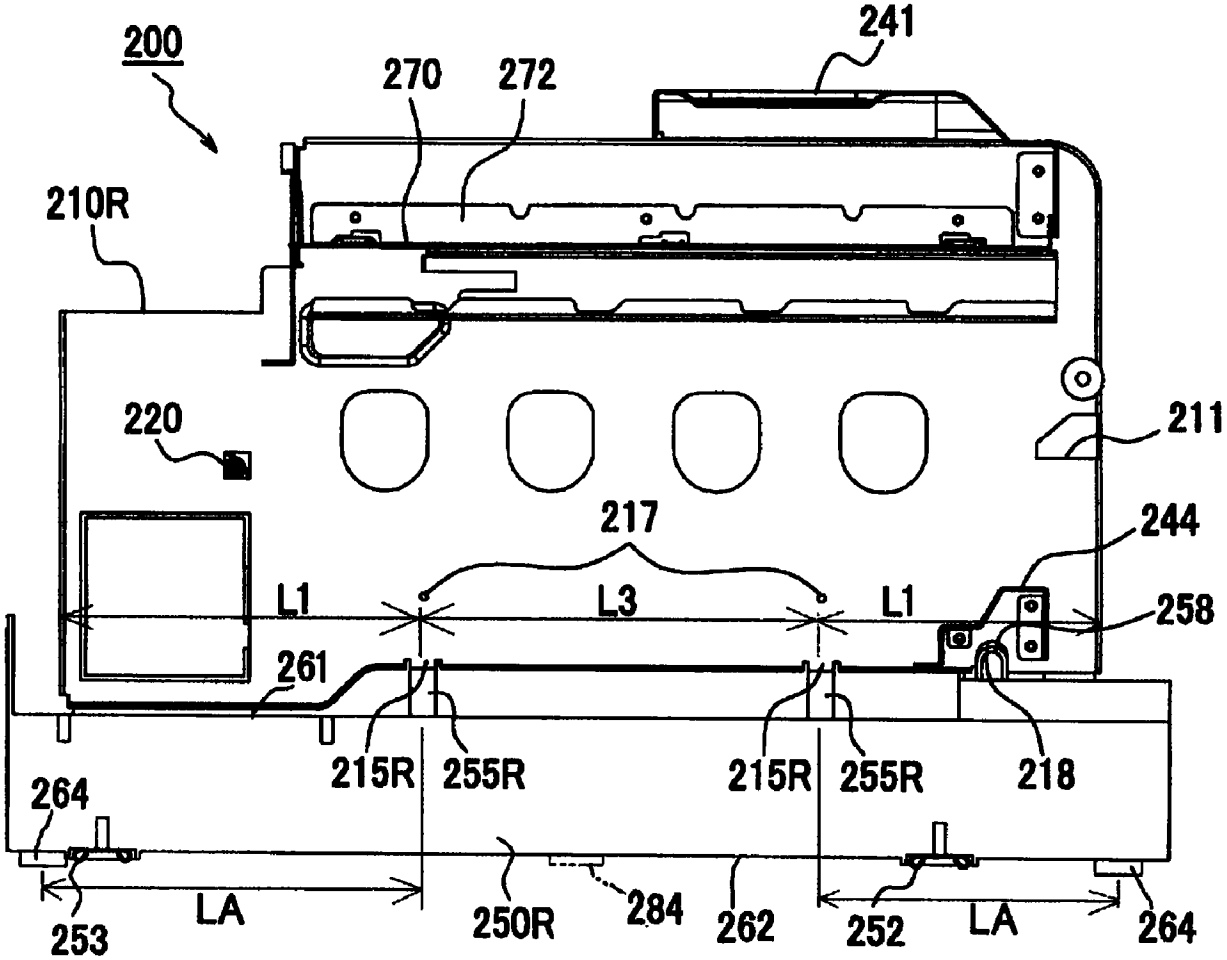
FIG. 8 is a cross-sectional view along the line F-F in FIG. 3.

The protruding pieces 215L and 215R are provided by plural numbers on the respective upper frames 210L and 210R. For example, two protruding pieces 215R are provided on the right upper frame 210R spaced from each other in the anteroposterior direction, while three protruding pieces 215L are provided on the left upper frame 210L on which a heavy weight is to be supported as mentioned above. As shown in FIGS. 7 and 8, the anteroposterior outermost protruding pieces 215L and 215R of the respective upper frames 210L and 210R (i.e., two protruding pieces 215L and two protruding pieces 215R provided outermost in the anteroposterior direction) are positioned at distances L1 inward from the anteroposterior ends of the respective upper frames 210L and 210R. On the outside of the protruding pieces 215L and 215R in the anteroposterior direction, there is a clearance between the lower ends of the upper frames 210L and 210R and the lower frames 250L and 250R.

The weight of a unit including the pair of upper frames 210L and 210R, coupling members 241, 242, 243, 244, 270, image forming unit 300 (including drawer unit 350, scanner unit 330, fixing unit 340, and belt unit 310), and the driving unit 500 for the image forming unit is supported on the upper surfaces of the pedestal portions 255L and 255R via the protruding pieces 215L and 215R. Also, the center of gravity thereof is located closer to the left upper frame 210L having the driving unit 500 with respect to the intermediate position between the pair of upper frames 210L and 210R as well as located, in plan view, inside an outline that connect portions where the outermost plurality of protruding pieces 215L and 215R are in contact with the pedestal portions 255L and 255R.

The distance L2 between the two anteroposterior outermost protruding pieces 215L of the left upper frame 210L is set greater than the distance L3 between the anteroposterior outermost two protruding pieces 21 SR of the right upper frame 210R.

The legs 264 provided on each of the lower frames 250L and 250R are positioned at distances LA outward in the anteroposterior direction from the anteroposterior outermost two protruding pieces 215L and 215R of the respective one of upper frames 210L and 210R. That is, the lower frames 250L and 250R extend outward in the anteroposterior direction with respect to the protruding pieces 215L and 215R, and the extending portions are elastically deformable upward substantially around the lower parts of the protruding pieces 215L and 215R.

U-shaped notched portions 218 opened downward are formed at the lower end edges in the vicinity of the front ends of the upper frames 210L and 210R, and U-shaped protrusions 258 protruding upward in a cross-sectional view are formed on the lower frames 250L and 250R at positions opposed to the notched portions 218. The engagement between the notched portions 218 and the protrusions 258 positions the upper frames 210L and 210R anteroposteriorly with respect to the lower frames 250L and 250R.

In addition, each of the lower frames 250L and 250R includes a plurality of fitting pieces 256 protruding upward from the vicinity of the pedestal portions 255L and 255R along the outer side surface of each of the upper frames 210L and 210R. Each of the fitting pieces 256 has an insertion hole 257 for insertion of a screw 251 bored therein. The upper frames 210L and 210R have screw holes 217 bored therein at positions opposed to the insertion holes 257 when the protruding pieces 215L and 215R are brought into contact with the respective pedestal portions 255L and 255R and the notched portions 218 are engaged with the respective protrusions 258. The upper frames 210L and 210R are fixed to the lower frames 250L and 250R when the screws 251 are inserted via the insertion holes 257 to be screwed into the respective screw holes 217.

Figure 9:
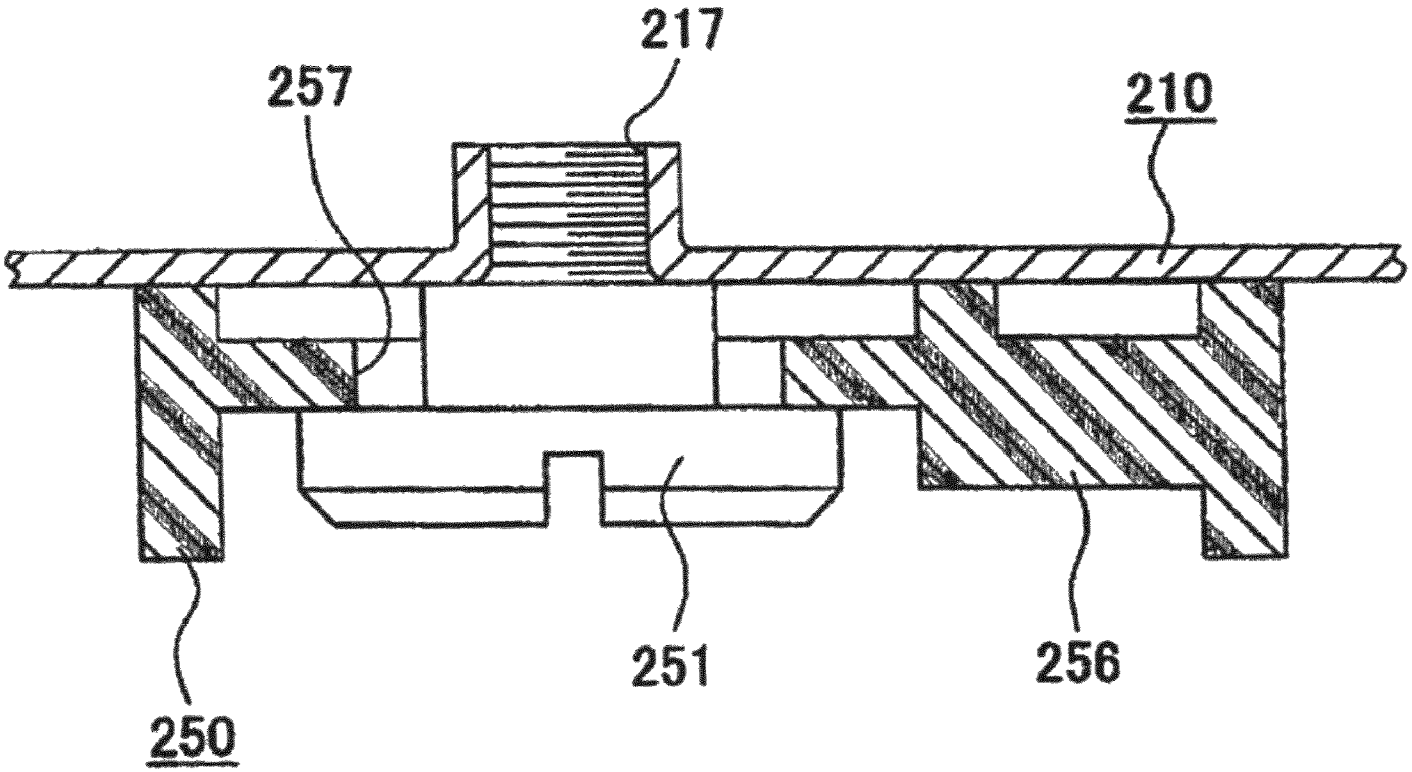
FIG. 9 is a horizontal cross-sectional view showing a portion at which a fitting piece of each lower frame and each upper frame are fixed.

As shown in FIG. 9, each of the screws 251 is a stepped screw including stepped portion, and the diameter of each of the insertion holes 257 is sufficiently greater than the diameter of the stepped portion of the respective one of the screws 251. For this reason, the screws 251 fix the fitting pieces 256 to the upper frames 210L and 210R loosely with no firm pressure at an extent allowing relative displacement in the anteroposterior and vertical directions. This allows the lower frames 250L and 250R and the upper frames 210L and 210R to be fixed regardless of the contact between the protruding pieces 215L and 215R and the pedestal portions 255L and 255R as well as the engagement positions of the notched portions 218 and the protrusions 258. Also, the fixation is in the vicinity of the protruding pieces 215L and 215R, which can reduce obstacles to deformation of the lower frames 250L and 250R, at the time of occurrence as will be described hereinafter. Further, even if the lower frames 250L and 250R and the upper frames 210L and 210R may have their respective different linear expansion coefficients, the differences in expansion or contraction due to temperature change can be absorbed.

(Advantages of Exemplary Embodiment)

In the apparatus according to the present exemplary embodiment, the weight of the unit including the frame body including the pair of upper frames 210L and 210R, the image forming unit 300, and the driving unit 500 are supported on the upper surfaces of the pedestal portions 255L and 255R via the protruding pieces 215L and 215R. The plurality of legs 264 provided on the lower frames 250L and 250R are positioned anteroposteriorly outside of the anteroposterior outermost two protruding pieces 215L and 215R of the respective upper frames 210L and 210R. Therefore, the weight is received by the elasticity of each of the lower frames 250L and 250R between the two front and rear legs 264.

When the upper frames 210L and 210R are applied with a downward impact or any one of the legs 264 is lifted by, for example, an irregularity on the placing surface, the extending portions of the lower frames 250L and 250R which are outside of the protruding pieces 215L and 215R in the anteroposterior direction are elastically deformed such that an inner side (on the side of the upper frames) thereof is deformed downward substantially around the legs 264. In other words, as indicated by the alternate long and two short dashed line in FIG. 7, the extending portions are elastically deformed upward substantially around the lower parts of the protruding pieces 215L and 215R. In this case, since there is a clearance between the upper surfaces of the extending portions of the lower frames 250L and 250R and the lower ends of the upper frames 210L and 210R, torsional moment and the like generated in the lower frames 250L and 250R have only an extremely small effect on the upper frames 210L and 210R. Also, if such an impact as mentioned above becomes so excessive that the amount of deformation of the lower frames 250L and 250R exceeds the height of the clearance, the upper surfaces of the extending portions of the lower frames 250L and 250R come into contact with the corresponding lower ends of the upper frames 210L and 210R to suppress the deformation, whereby plastic deformation or breakage of the lower frames 250L and 250R can be prevented.

Even if deflective and/or torsional moment and the like is applied from the lower frames 250L and 250R to the upper frames 210L and 210R, the deflective and/or torsional moment are applied in the vertical direction, that is, in the planar direction of the upper frames 210L and 210R. The stiffness of the upper frames 210L and 210R in the planar direction is greater than the vertical stiffness of the extending portions of the lower frames 250L and 250R. Consequently, a good positional accuracy can be ensured between the components in the image forming unit and, in particular, between the scanner unit 330 and the drawer unit 350, which allows accurate images with less color shift to be formed. Since the upper frames 210L and 210R form a frame body together with the coupling members 241, 242, 243, 244, and 270, the upper frames 210L and 210R can have a high stiffness in the other directions, which can ensure a better positional accuracy between the components in the image forming unit.

In addition, the distance L2 between the anteroposterior outermost two protruding pieces 215L of the left upper frame 210L closer to the center of gravity than the upper frame 210R is set greater than the distance L3 between the anteroposterior outermost two protruding pieces 215R of the right upper frame 210R. Therefore, the outermost four protruding pieces 215L and 215R have a substantially triangular arrangement, which facilitates the upper frames to be kept in a stable state even if distortions such as deflection and/or torsion may be generated in the lower frames 250L and 250R. Additionally, the center of gravity, which is closer to a side of the outline between the protruding pieces 215L which is larger than a side of the outline between the outermost protruding pieces 215R, is less likely to be displaced outside of the outlines connecting the four protruding pieces 215L and 215R even if the upper frames 210L and 210R may somewhat swing, whereby the upper frames 210L and 210R including the image forming unit 320 can be supported stably.

Moreover, even if the outermost four protruding pieces 215L and 215R may have a substantially triangular arrangement, the lower frames 250L and 250R extend outward with respect to the protruding pieces 215L and 215R in the anteroposterior direction, and the legs 264 are provided in the extending portions as mentioned above, whereby the image forming apparatus can be supported stably on the placing surface via a large area.

Further, since the foregoing arrangement of the protruding pieces 215L and 215R is achieved between the lateral pairs of upper frames 210L and 210R and lower frames 250L and 250R corresponding vertically to each other, the size of the support structure can be reduced without being made complicated. Additionally, the protruding pieces 215L and 215R and the notched portions 218 are arranged in the same plane as the inner surfaces of the upper frames 210L and 210R supporting the scanner unit 330 as well as the openings 211 and holes 212 supporting the drawer unit 350. This allows the weights of the scanner unit 330 and the drawer unit 350 to be received successfully on the upper surfaces of the pedestal portions 255L and 255R, and further the image forming unit 300 to be positioned accurately with respect to the lower frames 250L and 250R.

(Modifications of Exemplary Embodiment)

In the above-described exemplary embodiment, auxiliary legs 284 may be provided on the lower surfaces of the lower frames 250L and 250R at the intermediate position in the anteroposterior direction, as shown in FIGS. 7 and 8. The auxiliary legs 284 can limit downward displacement of the intermediate portions of the lower frames 250L and 250R associated with downward displacement of the upper frames 210L and 210R when the upper frames 210L and 210R are applied with a downward impact. The auxiliary legs 284 have a protrusion amount from the lower walls 262 smaller than that of the legs 264 and are not in contact with the placing surface 260 in an ordinary state.

Figure 11A:
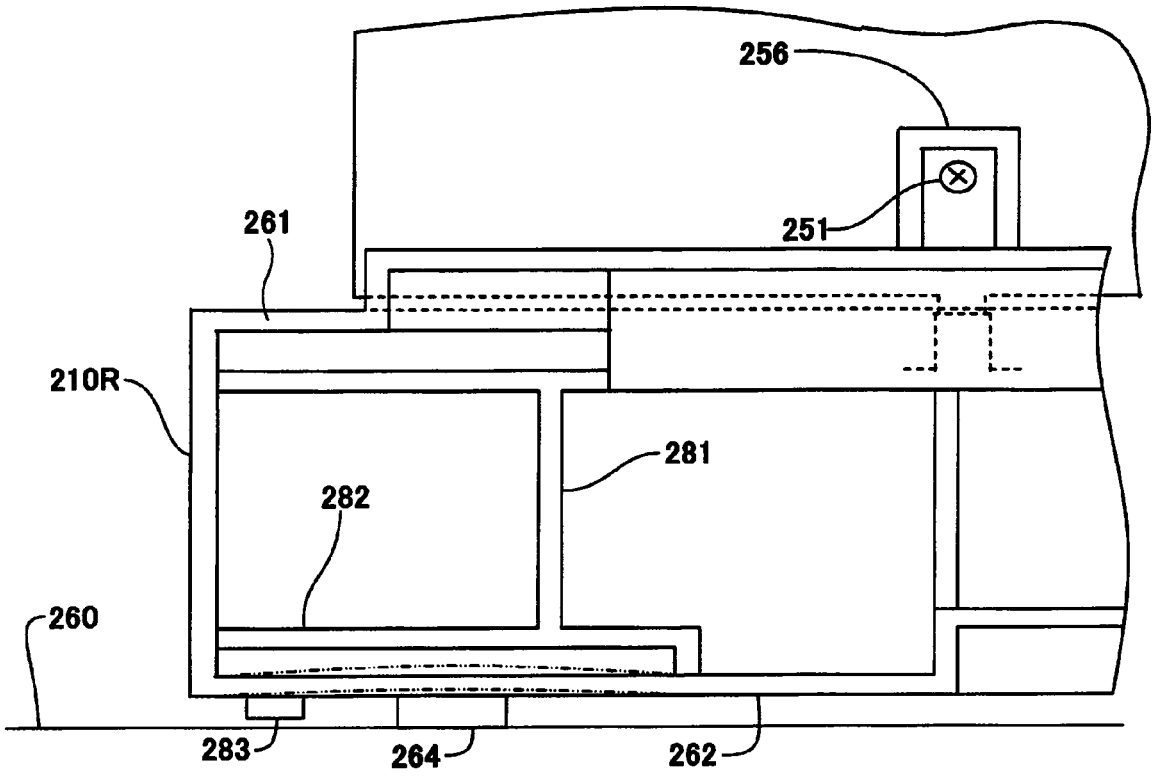
Figure 11B:
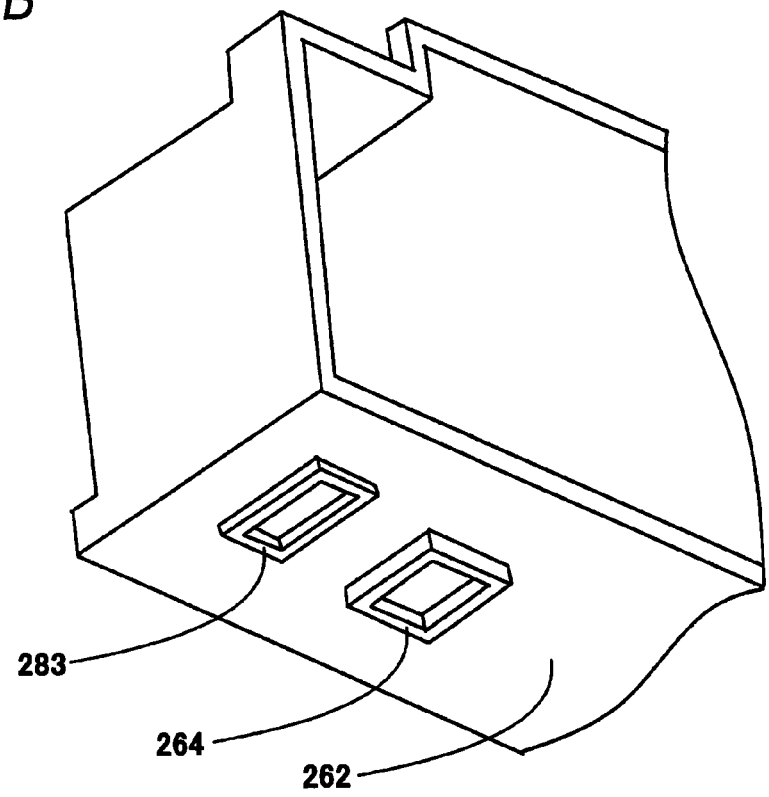

Although in the above-described exemplary embodiment, the portions extending outward with respect to the protruding pieces 215L and 215R of the lower frames 250L and 250R are adopted to be deformed elastically in the vertical direction, only part of the walls of the lower frames 250L and 250R may be adopted to be deformed elastically. For example, in an exemplary modification shown in FIGS. 11A and 11B, the lower wall 262 in the vicinity of the leg 264 is adopted to be deformed elastically. In this case, among vertical ribs 281 connecting the upper wall 261 and the lower wall 262, one running in the vicinity of the leg 264 is not connected directly to the lower wall 262 but connected to a horizontal rib 282 spaced from and formed in parallel with the lower wall 262, so that the portion of the lower wall 262 parallel to the horizontal rib 282 can be deformed elastically toward the inside of the lower frames 250L and 250R (that is, toward the internal space). The leg 264 is arranged on the lower surface of the lower wall 262 at a position corresponding to the intermediate position of the horizontal rib 282 in the anteroposterior direction.

With the arrangement above, if the upper frames 210L and 210R are applied with a downward impact or the placing surface has an irregularity as mentioned above, the portion of each lower wall 262 in the vicinity of each leg 264 is deformed elastically, which is less likely to affect the upper frames 210L and 210R.

It is noted that if part of the driving unit 500 is arranged in the space between the lower frames 250L and 250R, the part of the driving unit 500 may interfere with the extending portions of the lower frames 250L and 250R when the extending portions are deformed entirely as in the above-described exemplary embodiment. However, in this exemplary modification, the lower walls 262 are deformed partially and elastically to avoid such an interference.

In the exemplary modification above, it is necessary to dispose the legs 264 at a predetermined distance inward from the anteroposterior ends of the lower frames 250L and 250R to ensure a length for easy deformation of the lower walls 262. Therefore, when an external force is applied to the image forming apparatus, the apparatus may incline in the anteroposterior direction. To address this case, auxiliary legs 283 are provided outside of the legs 264 in the anteroposterior direction. The auxiliary legs 283 have a protrusion amount from the lower walls 262 smaller than that of the legs 264 and are not in contact with the placing surface 260 in an ordinary state. When the image forming apparatus begins to incline in the anteroposterior direction, the legs 283 come into contact with the placing surface 260 to prevent the inclination from increasing.

Although in the above-described exemplary embodiment, the protruding pieces 215L and 215R are provided on the upper frames 210L and 210R, such protruding pieces may be provided on the lower frames 250L and 250R and the lower ends of the upper frames 210L and 210R to be in contact with the pieces may be flat.

Although in the above-described exemplary embodiment, the screws 251 and 273 are used as fixing or fastening means, various heretofore known means such as resin pins adopted to fix parts utilizing the elasticity of resin may be used.

Although in the above-described exemplary embodiment, the photoconductor units 321 are supported on the upper frames 210L and 210R via the drawer unit 350, the units may be supported directly on the upper frames 210L and 210R. Further, although in the above-described exemplary embodiment, the inner support plates 265L and 265R are arranged inside of the upper frames 210L and 210R to support the drawer unit 350 and the belt unit 310 on the inner support plates 265L and 265R, the inner support plates 265L and 265R may be omitted to support the units directly on the upper frames 210L and 210R.

The present invention is also applicable to various image forming apparatuses such as black-and-white laser printers, facsimile apparatuses, and copiers. If the present invention is applied to black-and-white image forming apparatuses, the advantage of preventing color shift is not offered. However, distortions of images such as deformation of rectangular figures into rhombic ones can be reduced successfully.

What is claimed is:

1. An image forming apparatus comprising:

an image forming unit comprising a photoconductor unit and a scanner unit configured to scan and expose the photoconductor unit, the image forming unit being configured to form an image on a recording medium conveyed with respect to the photoconductor unit;

a frame body that surrounds the photoconductor unit, the frame body comprising:

a pair of upper frames extending substantially in parallel with each other in a vertical direction and an anteroposterior direction perpendicular to the vertical direction so as to be opposed to each other across the image forming unit, the upper frames comprising a positioning portion configured to position the photoconductor unit;

a scanner supporting member that couples the upper frames in a bridging manner and supports the scanner unit; and a frame coupling member that couples the upper frames in a bridging manner on an opposite side of the scanner supporting member across the photoconductor unit;

a pair of lower frames provided below the upper frames and extending substantially in parallel with the upper frames in the anteroposterior direction, each of the lower frames having an upper surface and a lower surface opposite the upper surface, the upper surface comprising a plurality of lower supporting portions each contacting a lower end of a respective one of the upper frames so as to support the respective one of upper frames thereon, and the lower surface comprising a bottom supported portion opposed to a placing surface for supporting the image forming apparatus; and wherein the plurality of lower supporting portions of each of the lower frames comprises a pair of outermost lower supporting portions in the anteroposterior direction, wherein a stiffness of each of the upper frames in a substantially planar direction along the vertical direction is greater than a stiffness of each of the lower frames along the vertical direction between the lower supporting portions and the bottom supported portion, and wherein each of the lower frames comprises an extending portion extending outward in the anteroposterior direction from the outermost lower supporting portion, and the extending portion is deformable upward substantially around the lower supporting portion with a stiffness smaller than the upper frames.

2. The image forming apparatus according to claim 1, wherein a center of gravity of a unit comprising the photoconductor unit, the scanner unit, the upper frames, the scanner supporting member, the frame coupling member, and a driving unit configured to drive the photoconductor unit is located closer to one of the upper frames than an intermediate position between the upper frames, and the center of gravity of the unit being also located inside an outline defined by connecting the outermost lower supporting portions of the lower frames in plan view, and wherein an anteroposterior distance between the outermost lower supporting portions of the one of the lower frames is greater than an anteroposterior distance between the outermost lower supporting portions of the other of the lower frames.

3. The image forming apparatus according to claim 1, wherein each of the lower frames comprises:

an upper wall having the upper surface and extending substantially in a horizontal direction;

a lower wall disposed below and spaced from the upper wall, the lower wall having the lower surface and extending substantially in the horizontal direction; and a sidewall connecting the upper wall and the lower wall and extending substantially in the vertical direction, wherein a space surrounded by the upper wall, the lower wall, and the sidewall is defined as an internal space which is opened laterally.

4. The image forming apparatus according to claim 3, wherein the lower wall of each of the lower frames includes a leg protruding downward to be in contact with the placing surface, and the lower wall is deformable in a vicinity of the leg toward the internal space with a stiffness smaller than the upper frames.

5. The image forming apparatus according to claim 1, wherein the lower surface of each of the lower frames comprises a leg protruding downward to be in contact with the placing surface, and wherein the stiffness of each of the upper frames in the vertical direction is greater than the stiffness of each of the lower frames between the lower, supporting portion and the leg.

6. The image forming apparatus according to claim 1, wherein the outermost lower supporting portions of each of the lower frames are spaced from ends of each of the upper frames in the anteroposterior direction, and wherein a clearance allowing each of the lower frames to be deformed is provided outside of the outermost lower support portions in the anteroposterior direction between the lower end of each of the upper frames and the upper surface of each of the lower frames, and the lower end of each of the upper frames is opposed to the upper surface of the respective one of the lower frames so as to prevent unacceptable deformation of the lower frames by the clearance.

7. The image forming apparatus according to claim 1, wherein the upper frames are made of sheet metal to have a planer shape at least between a coupling portion coupled to the scanner supporting member and the positioning portion.

8. The image forming apparatus according to claim 7, wherein the positioning portion has openings formed in the upper frames to be opposed to each other, and the photoconductor unit is positioned by contacting a shaft member extending between the openings.

9. The image forming apparatus according to claim 7, wherein the positioning portion has openings formed in the upper frames to be opposed to each other, and the photoconductor unit is positioned such that shaft members respectively protruding leftward and rightward from the photoconductor unit contact the respective openings.

10. The image forming apparatus according to claim 7, wherein each of the upper frames comprises one or more upper supported portions supported by the lower supporting portions of the respective one of the lower frames, and wherein the one or more upper supported portions, the coupling portion and the positioning portion are arranged on a same plane.

11. The image forming apparatus according to claim 1, wherein each of the upper frames comprises one or more upper supported portions supported by the lower supporting portions of the respective one of the lower frames, wherein each of the lower frames comprises a fitting piece protruding upward from a position adjacent to the upper supported portion of the respective one of upper side frames and extending along a side surface of the respective one of the upper frames, and wherein the fitting piece is fixed to the respective one of the upper frames through a fastening member such that a relative movement between the upper frames and the lower frames is allowed in the anteroposterior and vertical directions.

12. The image forming apparatus according to claim 1, wherein a plurality of the photoconductor units is arranged to be opposed to the scanner unit, and wherein said image forming apparatus comprises a belt configured to convey the recording medium to allow a transfer of images formed on the plurality of photoconductor units to the recording medium, the belt being disposed along an arranging direction of the photoconductor units and supported between the upper frames.

13. The image forming apparatus according to claim 1,
wherein a first space defined between the upper frames is opened from a first opening positioned at least one of ends of the first space in the anteroposterior direction,
wherein the upper frames comprise first rail members,
wherein a plurality of the photoconductor units form a drawer unit supported on the first rail members slidably in the anteroposterior direction such that the plurality of photoconductor units is allowed to be integrally drawn out from the first space through the first opening, and
wherein the positioning portion is configured to position the drawer unit such that the plurality of photoconductor units is opposed to the scanner unit when the drawer unit is positioned by the positioning portion.

14. The image forming apparatus according to claim 1,
wherein a second space defined between the lower frames is opened from a second opening positioned at least one of ends of the second space in the anteroposterior direction,
wherein the lower frames comprise second rail members, and
wherein the image forming apparatus comprises a feed tray configured to accommodate the recording medium, the feed tray being located in the second space and supported on the second rail members slidably in the anteroposterior direction.

15. The image forming apparatus according to claim 14, further comprising a lower coupling member that is located below the second space and couples the lower frames.

16. The image forming apparatus according to claim 1,
wherein each of the upper frames is made of metal, and
wherein each of the lower frames is made of resin.

17. An image forming apparatus configured to form an image on a recording medium conveyed with respect to an image forming unit, said apparatus comprising:
a pair of upper frames extending substantially in parallel with each other in a vertical direction and an anteroposterior direction perpendicular to the vertical direction so as to support the image forming unit;
a pair of lower frames provided below the upper frames and extending substantially in parallel with the upper frames in the anteroposterior direction, each of the lower frames having an upper surface and a lower surface opposite the upper surface, the upper surface comprising a plurality of lower supporting portions each contacting a lower end of a respective one of the upper frames so as to support the respective one of the upper frames thereon, and the lower surface comprising a bottom supported portion opposed to a placing surface for supporting the image forming apparatus; and
a coupling member that couples the upper frames in a bridging manner,
wherein a stiffness of each of the upper frames in a substantially planar direction along the vertical direction is greater than a stiffness of each of the lower frames along the vertical direction between the lower supporting portion and the bottom supported portion,
wherein the plurality of lower supporting portions of each of the lower frames comprises a pair of outermost lower supporting portions in the anteroposterior direction,
wherein a center of gravity of a unit comprising the image forming unit, the upper frames, the coupling member, and a driving unit configured to drive the image forming unit is located closer to one of the upper frames than an intermediate position between the upper frames, and the center of gravity of the unit being also located inside an outline defined by connecting the outermost lower supporting portions of the lower frames in plan view, and
wherein an anteroposterior distance between the outermost lower supporting portion of the one of the lower frames is greater than an anteroposterior distance between the outermost lower supporting portion of the other of the lower frames.

18. The image forming apparatus according to claim 17,
wherein the image forming unit comprises a photoconductor unit and a scanner unit configured to scan and expose the photoconductor unit,
wherein the upper frames comprise a positioning portion configured to position the photoconductor unit, and
wherein the coupling member comprises:
a scanner supporting member that couples the upper frames and supports the scanner unit; and
a frame coupling member that couples the upper frames on an opposite side of the scanner supporting member across the photoconductor unit.

19. The image forming apparatus according to claim 18,
wherein a first space defined between the upper frames is opened from a first opening positioned at at least one of ends of the first space in the anteroposterior direction,
wherein the upper frames comprise first rail members,
wherein a plurality of the photoconductor units form a drawer unit supported on the first rail members slidably in the anteroposterior direction such that the plurality of photoconductor units is allowed to be integrally drawn out from the first space through the first opening, and
wherein the positioning portion is configured to position the drawer unit such that the plurality of photoconductor units is opposed to the scanner unit when the drawer unit is positioned by the positioning portion.

20. The image forming apparatus according to claim 17, wherein each of the lower frames comprises:
an upper wall having the upper surface and extending substantially in a horizontal direction;
a lower wall disposed below and spaced from the upper wall, the lower wall having the lower surface and extending substantially in the horizontal direction; and
a sidewall connecting the upper wall and the lower wall and extending substantially in the vertical direction,
wherein a space surrounded by the upper wall, the lower wall, and the sidewall is defined as an internal space which is opened laterally.

21. The image forming apparatus according to claim 20, wherein the lower wall of each of the lower frames includes a leg protruding downward to be in contact with the placing surface, and the lower wall is deformable in a vicinity of the leg toward the internal space with a stiffness smaller than the upper frames.

22. The image forming apparatus according to claim 17,
wherein the lower surface of each of the lower frames comprises a leg protruding downward to be in contact with the placing surface, and
wherein the stiffness of each of the upper frames in the vertical direction is greater than the stiffness of each of the lower frames between the lower supporting portion and the leg.

23. The image forming apparatus according to claim 17, wherein each of the lower frames comprises an extending portion extending outward in the anteroposterior direction from the outermost lower supporting portion, and the extending portion is deformable upward substantially around the lower supporting portion with a stiffness smaller than the upper frames.

24. The image forming apparatus according to claim 23, wherein the outermost lower supporting portions of each of the lower frames are spaced from ends of each of the upper frames in the anteroposterior direction, and wherein a clearance allowing each of the lower frames to be deformed is provided outside of the outermost lower support portions in the anteroposterior direction between the lower end of each of the upper frames and the upper surface of each of the lower frames, and the lower end of each of the upper frames is opposed to the upper surface of the respective one of the lower frames so as to prevent unacceptable deformation of the lower frames by the clearance.

25. The image forming apparatus according to claim 17, wherein the upper frames are made of sheet metal to have a planer shape at least between a coupling portion coupled to the scanner supporting member and the positioning portion.

26. The image forming apparatus according to claim 25, wherein the positioning portion has openings formed in the upper frames to be opposed to each other, and the photoconductor unit is positioned by contacting a shaft member extending between the openings.

27. The image forming apparatus according to claim 25, wherein the positioning portion has openings formed in the upper frames to be opposed to each other, and the photoconductor unit is positioned such that shaft members respectively protruding leftward and rightward from the photoconductor unit contact the respective openings.

28. The image forming apparatus according to claim 25, wherein each of the upper frames comprises one or more upper supported portions supported by the lower supporting portions of the respective one of the lower frames, and wherein the one or more upper supported portions, the coupling portion and the positioning portion are arranged on a same plane.

29. The image forming apparatus according to claim 17, wherein each of the upper frames comprises one or more upper supported portions supported by the lower supporting portions of the respective one of the lower frames, wherein each of the lower frames comprises a fitting piece protruding upward from a position adjacent to the upper supported portion of the respective one of upper side frames and extending along a side surface of the respective one of the upper frames, and wherein the fitting piece is fixed to the respective one of the upper frames through a fastening member such that a relative movement between the upper frames and the lower frames is allowed in the anteroposterior and vertical directions.

30. The image forming apparatus according to claim 17, wherein a plurality of the photoconductor units is arranged to be opposed to the scanner unit, and wherein said image forming apparatus comprises a belt configured to convey the recording medium to allow a transfer of images formed on the plurality of photoconductor units to the recording medium, the belt being disposed along an arranging direction of the photoconductor units and supported between the upper frames.

31. The image forming apparatus according to claim 17, wherein a second space defined between the lower frames is opened from a second opening positioned at at least one of ends of the second space in the anteroposterior direction, wherein the lower frames comprise second rail members, and wherein the image forming apparatus comprises a feed tray configured to accommodate the recording medium, the feed tray being located in the second space and supported on the second rail members slidably in the anteroposterior direction.

32. The image forming apparatus according to claim 31, further comprising a lower coupling member that is located below the second space and couples the lower frames.

33. The image forming apparatus according to claim 17, wherein each of the upper frames is made of metal, and wherein each of the lower frames is made of resin.

34. An image forming apparatus comprising:

an image forming unit comprising a photoconductor unit and a scanner unit configured to scan and expose the photoconductor unit, the image forming unit being configured to form an image on a recording medium conveyed with respect to the photoconductor unit;

a frame body that surrounds the photoconductor unit, the frame body comprising:

a pair of upper frames extending substantially in parallel with each other in a vertical direction and an anteroposterior direction perpendicular to the vertical direction so as to be opposed to each other across the image forming unit, the upper frames comprising a positioning portion configured to position the photoconductor unit;

a scanner supporting member that couples the upper frames in a bridging manner and supports the scanner unit; and a frame coupling member that couples the upper frames in a bridging manner on an opposite side of the scanner supporting member across the photoconductor unit, a pair of lower frames provided below the upper frames and extending substantially in parallel with the upper frames in the anteroposterior direction, each of the lower frames having an upper surface and a lower surface opposite the upper surface, the upper surface comprising a plurality of lower supporting portions each contacting a lower end of a respective one of the upper frames so as to support the respective one of upper frames thereon, and the lower surface comprising a bottom supported portion opposed to a placing surface for supporting the image forming apparatus; and wherein the plurality of lower supporting portions of each of the lower frames comprises a pair of outermost lower supporting portions in the anteroposterior direction, wherein a stiffness of each of the upper frames in a substantially planar direction along the vertical direction is greater than a stiffness of each of the lower frames along the vertical direction between the lower supporting portions and the bottom supported portion, wherein the upper surface of each of the lower frames in the vertical direction is below a lowest portion of each of the upper frames, and wherein each of the lower frames comprises an extending portion extending outward in the anteroposterior direction from the outermost lower supporting portion, and the extending portion is deformable upward substantially around the lower supporting portion with a stiffness smaller than the upper frames.

35. The image forming apparatus according to claim 34, wherein the outermost lower supporting portions of each of the lower frames are spaced from ends of each of the upper frames in the anteroposterior direction, and wherein a clearance allowing each of the lower frames to be deformed is provided outside of the outermost lower support portions in the anteroposterior direction between the lower end of each of the upper frames and the upper surface of each of the lower frames, and the lower end of each of the upper frames is opposed to the upper surface of the respective one of the lower frames so as to prevent unacceptable deformation of the lower frames by the clearance.

* * * * *